US005094487A

United States Patent [19]

Drewry

[11] Patent Number: 5,094,487

[45] Date of Patent: Mar. 10, 1992

[54] SELF-DISENGAGING LOCKING DEVICE

[76] Inventor: Thomas L. Drewry, Rte. 4, Box 1105, Union City, Tenn. 38261

[21] Appl. No.: 691,520

[22] Filed: Apr. 25, 1991

[51] Int. Cl.[5] ..... B65F 1/12; E04C 3/00

[52] U.S. Cl. ..... 292/237; 292/205; 292/104; 292/131; 292/135; 414/414; 294/68.26

[58] Field of Search ..... 292/205, 252, 231, 131, 292/135, 104, 230, 237; 294/68.2, 68.1, 68.26; 414/414, 407, 408

[56] References Cited

U.S. PATENT DOCUMENTS

| | | | |
|---|---|---|---|
| 204,267 | 5/1878 | Unger | 292/135 |
| 1,760,305 | 5/1930 | Fildes | 292/135 |
| 2,274,259 | 2/1942 | Russo . | |
| 3,642,314 | 2/1972 | Smith et al. . | |
| 3,709,389 | 1/1973 | Steltz | 414/408 |
| 3,828,899 | 8/1974 | Scott | 292/231 |
| 3,954,172 | 5/1976 | Rinella | 292/131 |
| 4,088,071 | 5/1978 | Cruse et al. | 292/131 |
| 4,155,584 | 5/1979 | Pracenia | 294/68.1 |
| 4,182,530 | 1/1980 | Hodge | 294/68.26 |
| 5,015,021 | 5/1991 | Wyson et al. | 292/231 |

FOREIGN PATENT DOCUMENTS

| | | | |
|---|---|---|---|
| 687042 | 1/1940 | Fed. Rep. of Germany | 292/135 |
| 858652 | 12/1952 | Fed. Rep. of Germany | 292/237 |
| 311468 | 10/1933 | Italy | 292/237 |

*Primary Examiner*—Eric K. Nicholson

[57] ABSTRACT

An automatically disengaing locking device is provided for use on a container having a hinged lid pivotable between open and closed positions. The locking device consists of a housing mounted to the side surface of the container, and a latch securable to the lid having a portion which extends through an opening in the housing when the lid is closed. The locking device further includes a keeper element disposed within the housing for engaging the lower portion of the latch to secure the lid in its closed position, a manual release mechanism comprising a plunger for allowing the selective disengagement of the keeper from the latch, and a pendulum for automatically disengaging the keeper from the latch when the container is tilted for emptying.

13 Claims, 3 Drawing Sheets

SELF-DISENGAGING LOCKING DEVICE

BACKGROUND OF THE INVENTION

1. Field

The present invention relates to locking devices for use on containers having hinged lids, and, more particularly, to such locking devices which automatically become disengaged in order to allow emptying of the containers.

2. Description of the Prior Art

Large generally rectangular containers having hinged lids are commonly used for purposes of trash collection, particularly by businesses and apartment complexes. In order to open the lid to deposit refuse in such a container, one must simply lift the front portion of the lid to a sufficient degree. Typically, emptying of such a container is accomplished by a large, specially equipped truck, which has means for lifting and inverting the container, thereby allowing the lid to swing open and the contents to fall into a large bin located within the body of the truck.

Frequently, unauthorized persons not associated with the owner or rightful user of such containers will utilize the containers for their garbage disposal. This has resulted in a considerable problem, in that the containers often times become completely filled with the garbage of such unauthorized persons, leaving no room for the garbage of those persons paying for the container and related collection services. This problem has become particularly severe for rural apartment complexes, since their trash containers are often used by persons living in outlying areas who find the containers to be more convenient than a local landfill. As a result, apartment owners frequently are forced to pay for an additional pick-up to make room for their tenants' garbage.

Many trash containers include provisions for utilizing a locking device, such as a padlock, to prevent the lid from being opened by anyone not having the proper key, combination, or other unlocking means. When such locking devices are utilized, it is essential that the locking device be removed or otherwise disengaged prior to the arrival of the collection truck to allow emptying. Since it is usually difficult or impossible to precisely predict the arrival of the collection truck, the use of such locking devices has proven to be inadequate. Accordingly, a need has developed for a locking device which allows limited access to the trash container, but need not be attended to for purposes of dumping.

BRIEF SUMMARY OF THE INVENTION

It is an object of the present invention to alleviate the problems associated with conventional locking devices by providing a relatively inexpensive and simple device which automatically disengages itself when necessary for dumping. It is also an object of this invention to provide a locking device which can be maintained in either a completely unlocked state or in a locked state to allow access only to certain authorized persons.

In accordance with the teachings of the present invention, there is disclosed herein a preferred embodiment of a locking device having a latch member securable to the lid of a trash receptacle or similar container, and a keeper mounted within a housing on the side of the receptacle. The latch and housing are aligned such that, upon closure of the receptacle lid, a portion of the latch enters the housing through an opening in the top surface thereof and engages the keeper. Manual release means are provided to allow the user of the dumpster to disengage the keeper from the latch in order to raise the lid for depositing refuse within the container. The manual release mechanism is adapted to receive a lock, such as a padlock, to prevent its operation by unauthorized persons. Finally, the keeper consists of a pendulum, wherein the upper portion is configured for engagement with a latch and the lower portion is weighted to maintain the pendulum in an upright position, so that tilting of the container for dumping operates to disengage the keeper from the latch.

These and other objects of the present invention will become apparent from the reading of the following specification, taken in conjunction with the enclosed drawings.

DETAILED DESCRIPTION OF THE PREFERRED EMBODIMENT

Figure 1:
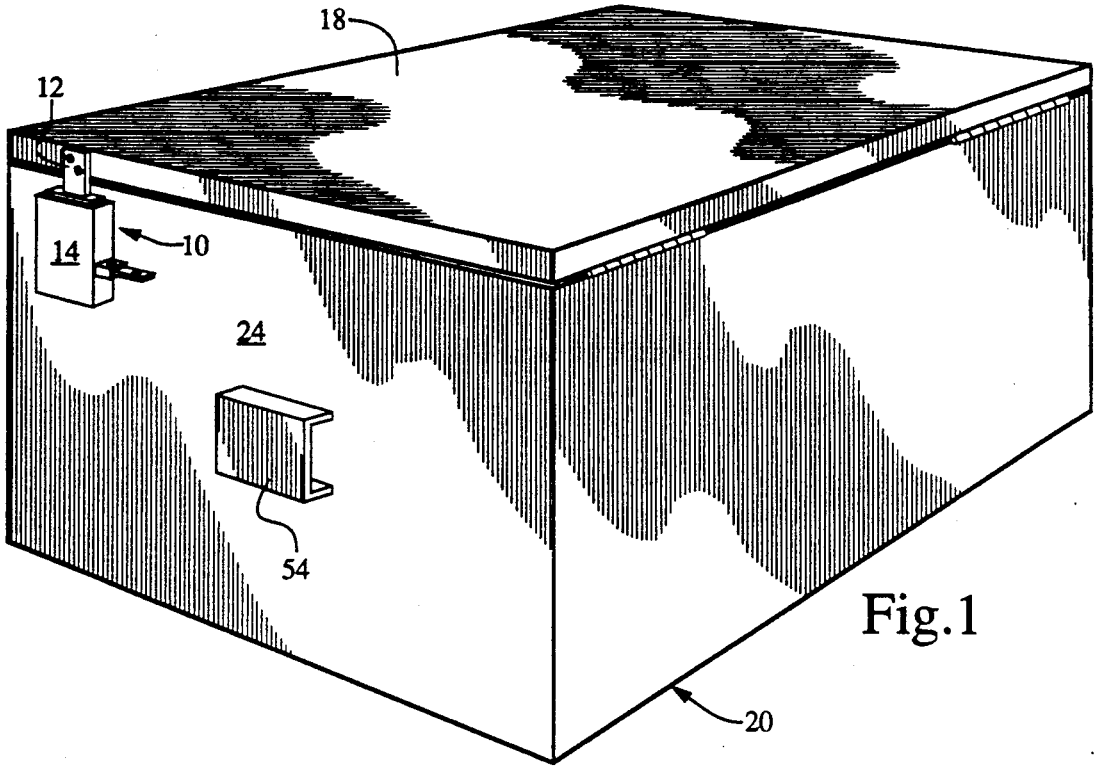
FIG. 1 is a perspective view of a typical container having the preferred locking device of the present invention operatively mounted thereon.
Figure 2:
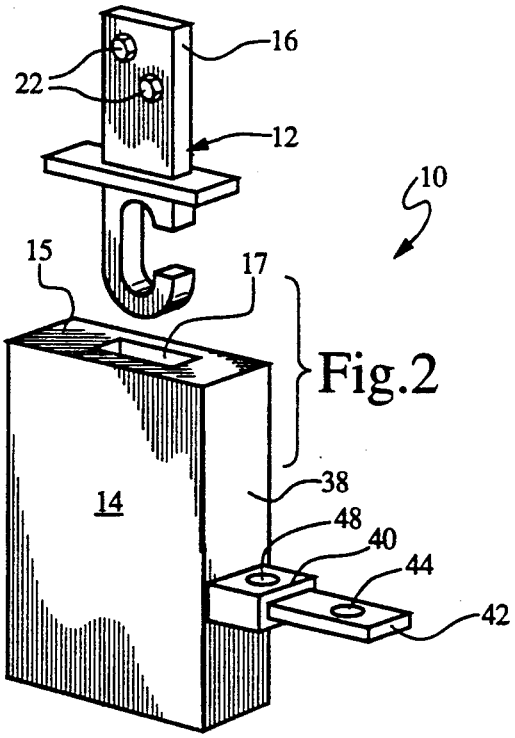
FIG. 2 is a partially exploded perspective view of the present invention.

Referring initially to FIG. 2, the preferred embodiment of locking device 10 is shown to include two main components, latch 12 and housing 14. The upper portion 16 of latch 12 includes provisions for securing latch 12 to the hinged lid 18 of a conventional refuse container 20 as shown in FIG. 1. In the embodiment shown, these provisions comprise screws 22, but it is expected that other attachment means such as riveting, welding, etc. could also be suitable for the purposes described herein. Housing 14 is similarly secured to side portion 24 of refuse container by screws (not shown) or other suitable means. The upper surface 15 of housing 14 includes a slot 17 formed therethrough for receiving hook 36 of latch 12.

Figure 3:
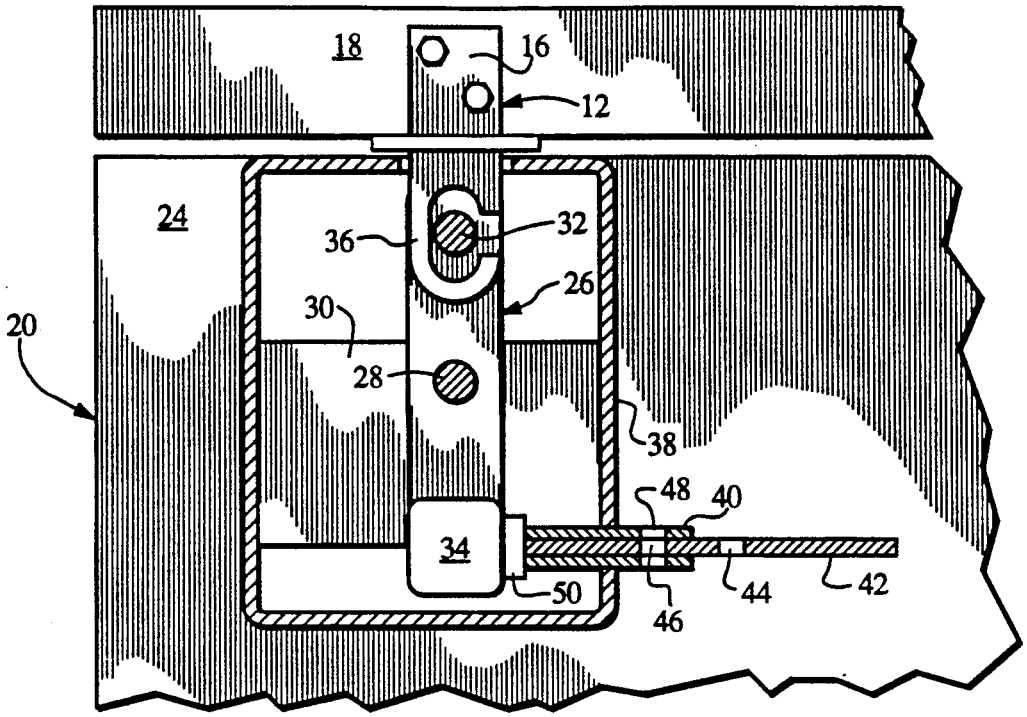
FIG. 3 is a front sectional view of the present invention, showing the keeper, and latch in their engaged positions.
Figure 4:
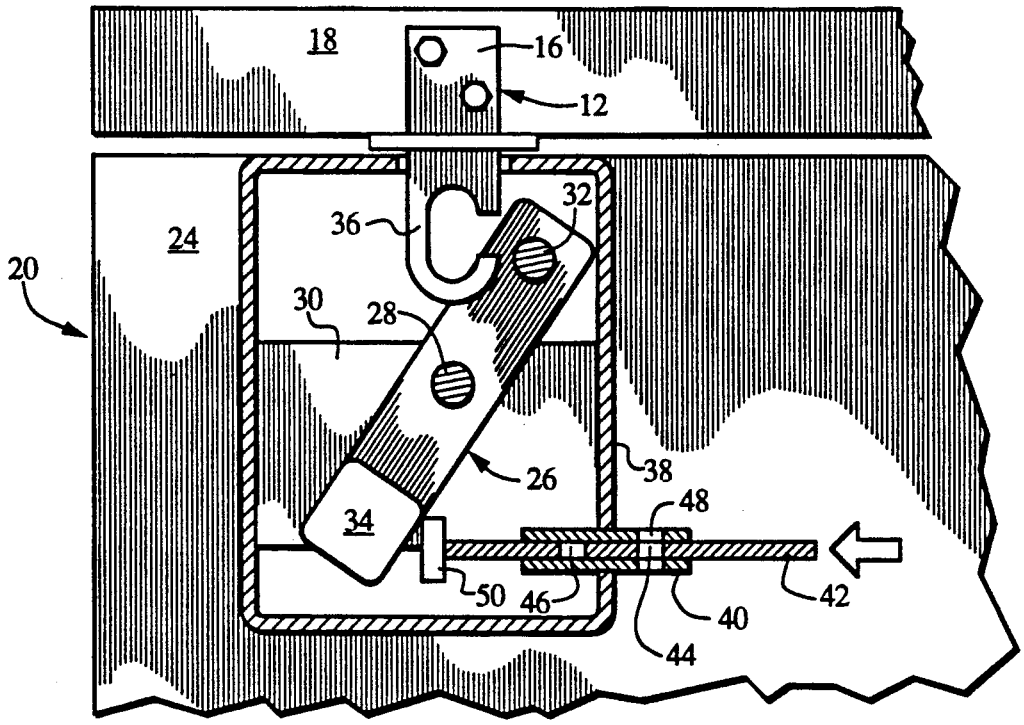
FIG. 4 is a front sectional view of the present invention, showing the manual release means in its depressed position and the keeper disengaged from the latch.

Pivotally mounted within housing 14 is keeper 26, as best shown in FIGS. 3 and 4. Keeper 26 preferably includes generally central post 28, which extends laterally between internal member 30 and the exterior wall of housing 14 and is rotatably mounted therebetween. The upper portion of keeper 26 includes a laterally extending finger 32, while the lower portion of keeper 26 comprises a weighted member 34. As shown in FIG. 3, finger 32 is positioned and adapted to be received and retained by lower hook portion 36 of latch 12. Member 34 is sufficiently heavy so that keeper 26 operates as a pendulum to maintain its generally upright position upon rotation of housing 14, as discussed more fully below.

Side 38 of housing 14 has generally rectangular passageway formed therein defined by duct 40. Slidably disposed within duct 40 is plunger 42, which includes two vertical holes 44 and 46. Duct 40 also includes a vertical hole 48, alignable with either hole 44 or 46 of plunger 42 for reasons discussed below. End portion 50 of plunger 42 abuts weighted member 34 of keeper 26.

Figure 5:
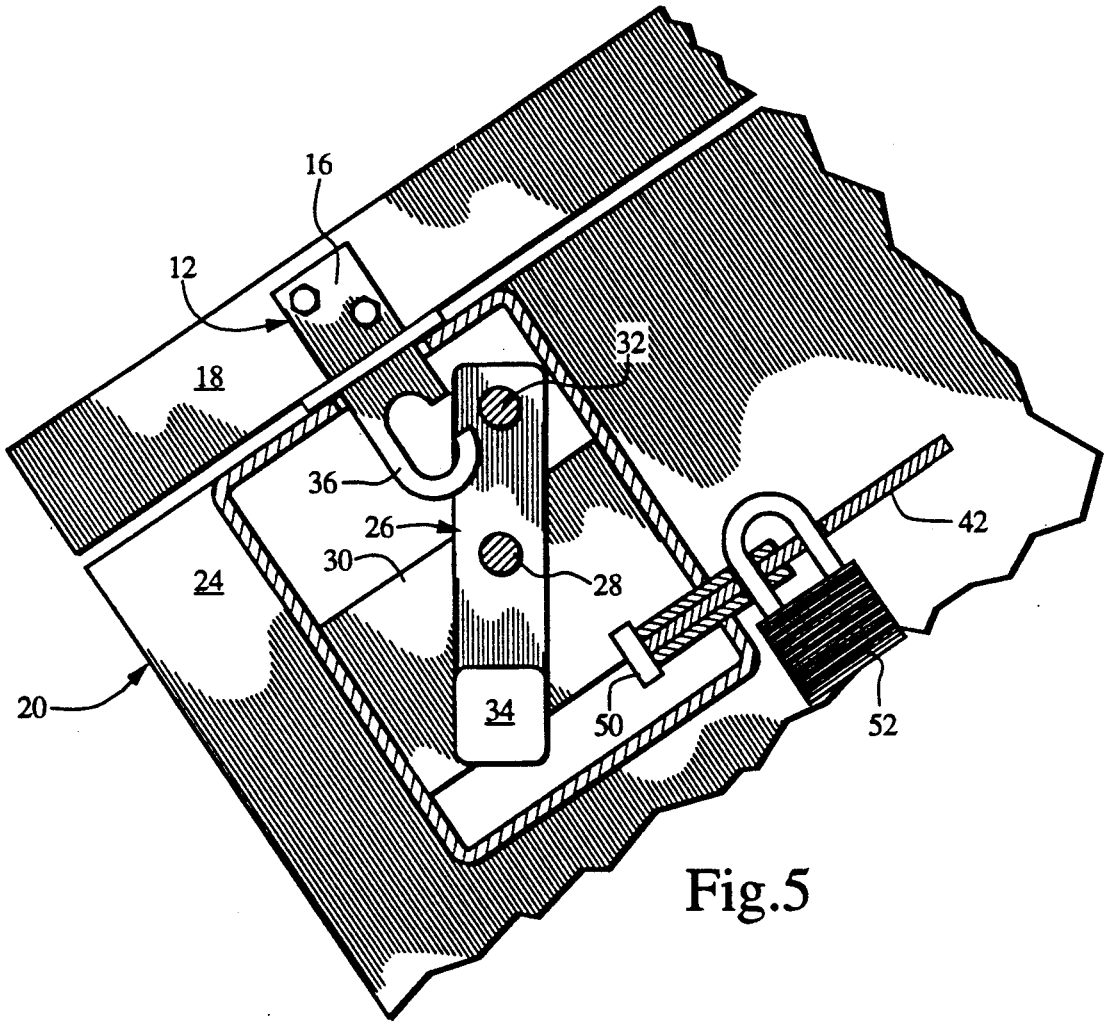
FIG. 5 is a front sectional view of the present invention, showing the automatic disengagement of the keeper from the catch upon tilting of the container.

With refuse container 20 in its normal, upright storage position as shown in FIG. 1, plunger 42 is typically maintained in its extended position as illustrated in FIG. 3. With plunger 42 in the extended position, finger 32 of keeper 26 is engaged with hook 36 of latch 12, thereby preventing the opening of lid 18. When the owner or other authorized user of refuse container 20 desires to dispose of trash, plunger 42 may be moved to its depressed position, as shown in FIG. 4, whereby end portion 50 drives weighted member 34 in a manner causing rotation of keeper 26 and consequent disengagement of finger 32 from hook 36 of latch 12. With plunger 42 held in the depressed position, lid 18 of refuse container 20 may be opened and closed as desired. In order to prevent the unauthorized usage of refuse container 20, padlock 52 may be secured through hole 48 of duct 40 and hole 46 of plunger 42 as shown in FIG. 5, padlock 52 being operative to prevent the lateral movement of plunger 42. With padlock 52 so disposed, only those persons having the key or combination to padlock 52 are provided access to refuse container 20. Alternatively, hole 44 of plunger 42 may be aligned with hole 48 and padlock 52 disposed therethrough, thereby maintaining plunger 42 in its depressed position to provide uninhibited access to refuse container 20.

As those skilled in the art will fully understand, refuse containers are typically emptied by collection vehicles having means for lifting and tilting such containers in a manner allowing the hinged lid to swing open and the contents fall out, relying primarily on the force of gravity. As shown in FIG. 1, refuse container 20 has a lifting member 54 disposed on each side thereof for this purpose. During the tilting of refuse container 20, weighted portion 34 tends to maintain keeper 26 in a generally upright or vertical position, thereby causing rotational movement of keeper 26 relative to latch 12, as illustrated in FIG. 5. Such relative rotational movement results in the disengagement of finger 32 from hook 36 of latch 12, the same as if plunger 42 had been moved to its depressed position. Accordingly, upon tilting of refuse container 20 to a sufficient degree, keeper 26 disengages latch 12 thereby allowing lid 18 to swing open and the trash to fall out of refuse container 20, without requiring the removal of padlock 52 and operation of plunger 42.

The materials of construction utilized for locking device 10 are generally non-critical for purposes of this invention. Steel, aluminum, or any other material of suitable strength and cost effectiveness may be employed. It may also be preferable to form keeper 26, or at least weighted member 34, from a non-magnetic material to prevent unauthorized access through the use of a magnet to effect the rotation of keeper 26. It is also foreseen that padlock 52 could be replaced by a locking device wholly contained within housing 14. However, the embodiment disclosed herein is considered to be preferable for purposes of simplicity, reliability, and cost.

While the principal of providing an automatically disengaging locking device for a refuse container has been made clear, it will be immediately apparent to those skilled in the art that there are many possible modifications to the disclosed embodiment without departing from the basic spirit of the present invention. Accordingly, the following claims are intended to cover and embrace not only the specific embodiment disclosed herein, but also such modifications within the spirit and scope of this invention.

What is claimed is:

1. A locking device for use on a container having a hinged lid pivotably between open and closed positions, said locking device comprising:

a housing, having an opening formed therein, mounted to a side surface of said container;

latch means, having a first portion securable to the lid of said container and a second portion extendable through said opening when said lid is in its closed position;

keeper means, disposed within said housing, for engaging said second portion of said latch means upon moving said lid to its closed position, thereby securing said lid in its closed position;

a plunger slidably disposed within a side portion of said housing for selectively disengaging said keeper means from said latch means to allow opening of said lid, said plunger comprising a first end disposed adjacent a portion of said keeper means, and a second end extending laterally from said side portion of said housing, whereby moving said second end toward said housing to slide said plunger laterally causes said first end to disengage said keeper means from said latch means; and automatic release means, operative for automatically disengaging said keeper means from said latch means to allow opening of said lid upon moving said container to a position suitable for dumping.

2. A locking device as set forth in claim 1, further comprising locking means for preventing the operation of said plunger.

3. A locking device as set forth in claim 2, wherein said locking means comprise a padlock.

4. A locking device as set forth in claim 1, wherein:

said keeper means comprise a pendulum member pivotably mounted within said housing, having an upper portion and a lower portion, said upper portion being adapted for engagement with said latch means, and said lower portion being weighted so that said pendulum is maintained in a generally vertical position throughout the tilting of said container during emptying, whereby upon tilting said container during emptying, said pendulum member moves arcuately with respect to said latch means, thereby disengaging said upper portion of said pendulum from said latch means.

5. A locking device as set forth in claim 4, wherein:

moving said second end of said plunger toward said housing causes said first end to drive said lower portion of said pendulum laterally, thereby disengaging said latch means from said upper portion of said pendulum.

6. A locking device for use on a container having a hinged lid movably between open and closed positions, emptying of said container being effected by raising and tilting said container to a degree sufficient to cause said lid to swing open and the contents of said container to fall therefrom, said locking device comprising:

a housing, mountable to a side portion of said container, having an aperture in the upper surface;

a latch member, mountable to a side portion of said lid, having a lower portion adapted to protrude into said aperture when said lid is moved to its closed position;

a keeper disposed within said housing, configured to releasably engage said lower portion of said latch member upon protrusion of said lower portion into said housing through said aperture, said keeper being adapted to automatically release said lower portion of said latch member during the tilting of said container for emptying, thereby allowing said lid to swing open;

a horizontally disposed plunger slidably mounted in a side wall of said housing, having a first end bearing on a portion of said keeper and a second end extending from said housing, said plunger being movably between an extending position, wherein said second end is spaced apart from said housing, and a depressed portion, wherein said second end is relatively close to said housing, whereby moving said plunger to said depressed position causes said first end to disengage said keeper from said latch member; and locking means for selectively preventing the operation of said plunger.

7. A locking device as set forth in claim 6, wherein:

said lower portion of said latch member comprises a generally hook-shaped element; and said keeper includes a post member configured for engagement with said hook-shaped element.

8. A locking device as set forth in claim 6, wherein:

said keeper comprises a generally vertically disposed pendulum pivotably mounted within said housing, having an upper end adapted for engagement with said lower portion of said latch member, and a lower end sufficiently weighted to maintain said pendulum in its generally vertical position throughout the tilting of said container during emptying; and said lower portion of said latch member is adapted to allow said upper end of said pendulum to swing out of engagement therewith during tilting of said container as said pendulum moves accurately with respect to said latch member.

9. A locking device as set forth in claim 8, wherein:

moving said plunger to said depressed position causes said first end to drive said lower end of said plunger laterally, thereby rotating said pendulum to effect the disengagement of said upper end from said latch member.

10. A locking device as set forth in claim 9, wherein:

said plunger includes at least one hole formed therethrough, said hole being disposed on the exterior of said housing when said plunger is in said extended position; and said locking means comprise a padlock, operatively disposed through said hole to prevent movement of said plunger from said extended position to said depressed position.

11. A locking device as set forth in claim 9, wherein:

said housing includes a duct horizontally disposed through a wall portion thereof, said plunger being slidably disposed within said duct and extending therethrough, said duct having at least one vertical hole formed therethrough;

said plunger includes at least one vertical hole formed therethrough, said hole being aligned with said hole in said duct when said plunger is in said extended position; and said locking means is removably disposed at least partially through said aligned holes in said plunger and said duct to prevent movement of said plunger.

12. A locking device as set forth in claim 11, wherein said locking means comprise a padlock.

13. A locking device as set forth in claim 11, wherein;

said plunger includes a second vertical hole formed therethrough, said second hole being aligned with said hole in said duct when said plunger is in said depressed position.

* * * * *